United States Patent [19]

Borneman

[11] 4,286,986

[45] Sep. 1, 1981

[54] FERRITIC STAINLESS STEEL AND PROCESSING THEREFOR

[75] Inventor: Paul R. Borneman, Sarver, Pa.

[73] Assignee: Allegheny Ludlum Steel Corporation, Pittsburgh, Pa.

[21] Appl. No.: 62,821

[22] Filed: Aug. 1, 1979

[51] Int. Cl.[3] ..... C22C 38/26; C22C 38/48

[52] U.S. Cl. ..... 75/126 F; 75/124; 75/125; 75/128 G; 148/2; 148/12 EA; 148/37

[58] Field of Search ..... 75/126 F, 128 G, 126 C, 75/126 D, 128 T, 128 W; 148/37, 2, 12 EA

[56] References Cited

U.S. PATENT DOCUMENTS

| | | | |
|---|---|---|---|
| 2,191,790 | 2/1940 | Franks | 75/126 F |
| 2,905,577 | 9/1959 | Harris et al. | 148/12 EA X |
| 3,499,802 | 3/1970 | Lagneborg | 148/37 |
| 3,650,731 | 3/1972 | Aggen | 75/128 T |
| 3,759,705 | 9/1973 | Chalk | 75/126 F X |
| 3,852,063 | 12/1974 | Niimi et al. | 75/124 |
| 3,890,143 | 6/1975 | Skoglund et al. | 75/126 D |
| 3,926,685 | 12/1975 | Gueussier et al. | 148/12 EA |
| 4,055,416 | 10/1977 | Oldrieve | 75/126 D X |
| 4,059,440 | 11/1977 | Takemura et al. | 75/126 C |
| 4,087,287 | 5/1978 | Dunning et al. | 148/3 |

OTHER PUBLICATIONS

Whittenberger et al., "Elevated Temperature Mechanical Properties and Cyclic Oxidation Resistance of Several Wrought Ferrtic Stainless Steels," Metals Technology, Nov. 1978, pp. 365–371.

*Primary Examiner*—Peter K. Skiff
*Attorney, Agent, or Firm*—James C. Valentine

[57] ABSTRACT

Careful control of chemistry, and in particular niobium, and of annealing temperatures provides a ferritic stainless steel of improved creep strength. Annealing is performed at a temperature of at least 1900° F., and in certain embodiments, at a temperature no higher than 1990° F.

15 Claims, No Drawings

FERRITIC STAINLESS STEEL AND PROCESSING THEREFOR

The present invention relates to a ferritic stainless steel and the manufacture thereof.

The lower coefficient of thermal expansion of ferritic stainless steels, in comparison to austenitic stainless steels, renders them attractive for elevated temperature applications such as exhaust pollution control systems and various heat transfer devices. Detracting from their attractiveness is the fact that their creep strength is generally not equal to that of the austenitic steels.

Through the present invention there is provided a ferritic stainless steel of improved creep strength and a process for providing the steel. Niobium is added to a ferritic stainless steel melt in specific well defined amounts. The melt is subsequently cast, worked and annealed at a temperature of at least 1900° F.

U.S. Pat. No. 4,087,287 describes a niobium bearing ferritic stainless steel of improved creep strength, but yet one which is dissimilar to that of the subject invention. Among other differences in chemistry, niobium is not controlled within the tight limits of the subject invention. Processing is also dissimilar from that of the subject invention.

An article entitled, "Elevated Temperature Mechanical Properties and Cyclic Oxidation Resistance of Several Wrought Ferritic Stainless Steels", by J. D. Whittenberger, R. E. Oldrieve and C. P. Blankenship discusses creep properties for ferritic stainless steels. The article appeared in the November 1978 issue of *Metals Technology*, pages 365–371. It does not disclose the niobium-bearing steel of the subject invention. Moreover, it discloses a maximum annealing temperature of 1285° K. (1825° F.), whereas the minimum annealing temperature for the subject invention is 1900° F.

A third reference, U.S. Pat. No. 4,059,440, discloses a niobium-bearing ferritic stainless steel, but not one within the limits of the subject invention. U.S. Pat. No. 4,059,440 is not at all concerned with creep strength. No reference to an anneal at a temperature of at least 1900° F. is found therein.

It is accordingly an object of the present invention to provide an improved ferritic stainless steel and a process for the manufacture thereof.

By carefully controlling chemistry, and in particular niobium, and by controlling processing to include an anneal at a temperature of at least 1900° F., the present invention provides a ferritic stainless steel of improved creep strength and a process for producing it. The present invention provides an 11 to 20% chromium ferritic stainless steel characterized by a creep life to one percent elongation at 1600° F. under a load of 1200 pounds per square inch, of at least 160 hours and preferably at least 250 hours.

Processing for the subject invention comprises the steps of: preparing a steel melt containing, by weight, up to 0.1% carbon, up to 0.05% nitrogen, from 11 to 20% chromium, up to 5% aluminum, up to 5% molybdenum, up to 1.5% manganese, up to 1.5% silicon, up to 0.5% nickel, up to 0.5% copper, up to 0.6% titanium and from 0.63 to 1.15% effective niobium (discussed hereinbelow); casting the steel; working the steel; and annealing the steel at a temperature of at least 1900° F. Part of the niobium may be replaced by tantalum so as to provide an effective niobium and tantalum content in accordance with the following equation:

$$\frac{\text{Effective Nb}}{0.9291} + \frac{\text{Effective Ta}}{1.8095} = 0.68 \text{ to } 1.24\%$$

Effective niobium and tantalum are computed, in accordance with the following:

$$\frac{\text{weight \% Ti}}{47.90} - \frac{\text{weight \% N}}{14.01} - \frac{\text{weight \% C}}{12.01} = A$$

If A is positive or zero:
Then Effective Nb content = weight % Nb
Effective Ta content = weight % Ta
If A is negative:
Then When Ta is absent
Effective Nb content =

$$92.91\left(\frac{\text{weight \% Nb}}{92.91} + A\right)$$

When Nb and Ta are present together $$92.91\left(\frac{\text{weight \% Nb}}{92.91} + A\right) = B$$

Then if B is positive or zero:
Effective Nb content = B
Effective Ta content = weight % Ta
If B is negative:
Effective Nb content = 0
Effective Ta content =

$$180.95\left(\frac{\text{weight \% Ta}}{180.95} + \frac{\text{weight \% Nb}}{92.91} + A\right)$$

Tantalum which may be present as an impurity in niobium is not, in the absence of specific tantalum additions, taken into account in determining effective niobium and tantalum contents. The effective tantalum content is usually less than four times the effective niobium content.

The steel is annealed at a temperature of at least 1900° F. so as to improve its creep strength. The annealing time is usually for a period of from 10 seconds to 10 minutes. Longer annealing times can be uneconomical, and in addition, can adversely affect grain size. Grain size control is significant in those instances where the steel is to be cold formed. Steel which is to be cold formed should be characterized by a structure wherein substantially all of the grains are about ASTM No. 5 or finer. As excessive grain growth can occur at higher temperatures, a particular embodiment of the subject invention is dependent upon a maximum annealing temperature of 1990° F.

The alloy of the subject invention is a ferritic stainless steel which consists essentially of, by weight, up to 0.1% carbon, up to 0.05% nitrogen, from 11 to 20% chromium, up to 5% aluminum, up to 5% molybdenum, up to 1.5% manganese, up to 1.5% silicon, up to 0.5% nickel, up to 0.5% copper, up to 0.6% titanium, and niobium and tantalum in accordance with the following:

(a) 0.63 to 1.15% effective niobium, in the absence of tantalum.

(b) effective niobium and tantalum in accordance with the equation $$\frac{\text{Effective Nb}}{0.9291} + \frac{\text{Effective Ta}}{1.8095} = 0.68 \text{ to } 1.24\%,$$

when both niobium and tantalum are present, balance essentially iron. As described hereinabove, effective niobium and tantalum are computed, in accordance with the following:

$$\frac{\text{weight \% Ti}}{47.90} - \frac{\text{weight \% N}}{14.01} - \frac{\text{weight \% C}}{12.01} = A$$

If A is positive or zero:

Then Effective Nb content = weight % Nb

Effective Ta content = weight % Ta

If A is negative:

Then When Ta is absent

Effective Nb content =

$$92.91\left(\frac{\text{weight \% Nb}}{92.91} + A\right)$$

When Nb and Ta are present together $$92.91\left(\frac{\text{weight \% Nb}}{92.91} + A\right) = B$$

Then if B is positive or zero:

Effective Nb content = B

Effective Ta content = weight % Ta

If B is negative:

Effective Nb content = 0

Effective Ta content =

$$180.95\left(\frac{\text{weight \% Ta}}{180.95} + \frac{\text{weight \% Nb}}{92.91} + A\right)$$

Carbon and nitrogen are preferably maintained at maximum levels of 0.03%. At least 11% chromium is required to provide sufficient oxidation resistance for use at elevated temperatures. Chromium is kept at or below 20% to restrict the formation of embrittling sigma phase at elevated temperatures. Up to 5% aluminum may be added to improve the steel's oxidation resistance. When added, additions are generally of from 0.5 to 4.5%. Molybdenum may be added to improve the alloy's creep strength. Additions are generally less than 2.5% as molybdenum can cause catastrophic oxidation. Titanium may be added to affect stabilization of carbon and nitrogen as is known to those skilled in the art. Niobium (with or without tantalum) in critical effective amounts greater than that required for stabilization, has been found to provide an increase in elevated temperature creep life values. Some niobium and/or tantalum may act as a stabilizer in lieu of titanium, without materially affecting the equations discussed hereinabove. Manganese, silicon, copper and nickel may be present within the ranges set forth hereinabove, for reasons well known to those skilled in the art.

The ferritic stainless steel of the subject invention is characterized by a creep life to one percent elongation at 1600° F. under a load of 1200 pounds per square inch, of at least 160 hours and preferably at least 250 hours. A particular embodiment thereof, is as discussed hereinabove, characterized by a structure wherein substantially all of the grains are about ASTM No. 5 or finer.

The following examples are illustrative of several aspects of the invention.

EXAMPLE I

Samples from two heats (Heats A and B) were hot rolled, cold rolled to a thickness of 0.05 inch and annealed at temperatures at 1997° and 2045° F. The chemistry of the heats appears hereinbelow in Table I.

TABLE I

| | Composition (wt. %) | | | | | | | | | | |
|---|---|---|---|---|---|---|---|---|---|---|---|
| Heat | C | N | Cr | Al | Mo | Mn | Si | Ni | Ti | Nb | Fe |
| A | 0.017 | 0.009 | 11.50 | 0.021 | 0.01 | 0.39 | 0.43 | 0.23 | 0.14 | 0.74 | Bal. |
| B | 0.02 | 0.027 | 19.10 | 0.020 | 0.028 | 0.42 | 0.55 | 0.32 | 0.26 | 0.68 | Bal. |

The samples were tested for creep life to one percent elongation at 1600° F. under a load of 1200 pounds per square inch. The test results appear hereinbelow in Table II.

TABLE II

| HEAT | ANNEALING TEMPERATURE (°F.) | LIFE (hours) | EFFECTIVE NIOBIUM (wt. %) |
|---|---|---|---|
| A | 1997 | 165 | 0.74 |
| A | 2045 | 282 | 0.74 |
| B | 1997 | 255 | 0.68 |
| B | 2045 | 395 | 0.68 |

From Table II, it is noted that all of the samples had a creep life to one percent elongation at 1600° F. under a load of 1200 pounds per square inch in excess of 160 hours. Significantly, each was processed within the limits of the subject invention. All had an effective niobium content within the 0.63 to 1.15% range discussed hereinabove, and all were annealed at a temperature in excess of 1900° F. It is also noted that 75% of the samples had a creep life in excess of 250 hours.

EXAMPLE II

Samples from three heats (Heats C, D and E) were hot rolled, cold rolled to a thickness of 0.05 inch and annealed at temperatures of 1950° and 2064° F. The chemistry of the heats appears hereinbelow in Table III.

TABLE III

| | Composition (wt. %) | | | | | | | | | | |
|---|---|---|---|---|---|---|---|---|---|---|---|
| Heat | C | N | Cr | Al | Mo | Mn | Si | Ni | Ti | Nb | Fe |
| C | 0.028 | 0.011 | 16.19 | 0.029 | 0.031 | 0.39 | 0.41 | 0.27 | 0.36 | 0.42 | Bal. |
| D | 0.029 | 0.015 | 16.27 | 0.025 | 0.031 | 0.39 | 0.39 | 0.27 | 0.32 | 0.61 | Bal. |

TABLE III-continued

| Heat | Composition (wt. %) | | | | | | | | | | |
|---|---|---|---|---|---|---|---|---|---|---|---|
| | C | N | Cr | Al | Mo | Mn | Si | Ni | Ti | Nb | Fe |
| E | 0.025 | 0.012 | 14.34 | 0.002 | 0.001 | 0.37 | 0.38 | 0.25 | 0.001 | 0.65 | Bal. |

The samples were tested for creep life to one percent elongation at 1600° F. under a load of 1200 pounds per square inch. The test results appear hereinbelow in Table IV.

TABLE IV

| HEAT | ANNEALING TEMPERATURE (°F.) | LIFE (hours) | EFFECTIVE NIOBIUM (wt. %) |
|---|---|---|---|
| C | 1950 | 60 | 0.42 |
| C | 2064 | 13 | 0.42 |
| D | 1950 | 130 | 0.61 |
| D | 2064 | 65 | 0.61 |
| E | 1950 | 148 | 0.38 |
| E | 2064 | 67 | 0.38 |

From Table IV, it is noted that none of the samples had a creep life to one percent elongation at 1600° F. under a load of 1200 pounds per square inch of 160 hours. None of the samples were processed in accordance with the subject invention, despite the fact that they were annealed at temperatures in excess of 1900° F. Not one of them had an effective niobium content as high as 0.63%. With regard thereto, it is noted that Heat E had a niobium content of 0.65%, but an effective niobium content of only 0.38%.

EXAMPLE III

Samples from a niobium-free, high titanium heat (Heat F) were hot rolled, cold rolled to a thickness of 0.05 inch and annealed at temperatures of 1938° and 2000° F. The chemistry of the heat appears hereinbelow in Table V.

TABLE V

| Heat | Composition (wt. %) | | | | | | | | | | |
|---|---|---|---|---|---|---|---|---|---|---|---|
| | C | N | Cr | Al | Mo | Mn | Si | Ni | Ti | Nb | Fe |
| F | 0.015 | 0.012 | 11.62 | 0.026 | 0.024 | 0.39 | 0.43 | 0.15 | 0.62 | <0.01 | Bal. |

The samples were tested for creep life to one percent at 1600° F. under a load of 1200 pounds per square inch. The test results appear hereinbelow in Table VI.

TABLE VI

| HEAT | ANNEALING TEMPERATURE (°F.) | LIFE (hours) | EFFECTIVE NIOBIUM (wt. %) |
|---|---|---|---|
| F | 1938 | 21 | 0 |
| F | 2000 | 13 | 0 |

From Table VI, it is evident that titanium does not improve creep life as does niobium. The longest creep life to one percent elongation at 1600° F. under a load of 1200 pounds per square inch is 21 hours, despite the fact that the titanium content is 0.62%. On the other hand, niobium-bearing heats A and B with respective titanium contents of 0.14 and 0.26%, have creep life values in excess of 160 hours (see Example I.).

EXAMPLE IV

Samples from four heats (Heats G, H, I and J) were hot rolled, cold rolled to a thickness of 0.05 inch and annealed at temperatures of 1913° and 2064° F. The chemistry of the heats appears hereinbelow in Table VII.

TABLE VII

| Heat | Composition (wt. %) | | | | | | | | | | |
|---|---|---|---|---|---|---|---|---|---|---|---|
| | C | N | Cr | Al | Mo | Mn | Si | Ni | Ti | Nb | Fe |
| G | 0.030 | 0.015 | 16.16 | 0.026 | 0.031 | 0.38 | 0.39 | 0.27 | 0.30 | 0.80 | Bal. |
| H | 0.026 | 0.011 | 16.11 | 0.032 | 0.041 | 0.37 | 0.38 | 0.26 | 0.36 | 1.00 | Bal. |
| I | 0.027 | 0.011 | 16.03 | 0.024 | 0.041 | 0.37 | 0.38 | 0.26 | 0.35 | 1.20 | Bal. |
| J | 0.028 | 0.011 | 16.01 | 0.022 | 0.040 | 0.37 | 0.38 | 0.26 | 0.33 | 1.40 | Bal. |

The samples were tested for creep life to one percent elongation at 1600° F. under a load of 1200 pounds per square inch. The test results appear hereinbelow in Table VIII.

TABLE VIII

| HEAT | ANNEALING TEMPERATURE (°F.) | LIFE (hours) | EFFECTIVE NIOBIUM (wt. %) |
|---|---|---|---|
| G | 1913 | 222 | 0.80 |
| G | 2064 | 158 | 0.80 |
| H | 1913 | 230 | 1.00 |
| H | 2064 | 272 | 1.00 |
| I | 1913 | 69 | 1.20 |
| I | 2064 | 56 | 1.20 |
| J | 1913 | 21 | 1.40 |
| J | 2064 | 36 | 1.40 |

From Table VIII, it is noted that the samples from Heats G and H had a creep life to one percent at 1600° F. under a load of 1200 pounds per square inch about or in excess of 160 hours and that the samples from Heats I and J had a creep life of a substantially shorter duration. Significantly, the samples from Heats G and H were processed in accordance with the subject invention, whereas those from Heats I and J were not. The samples from Heats G and H had an effective niobium content below 1.15%, whereas those from Heats I and J had an effective niobium content in excess of 1.15%. Alloys within the subject invention have an effective niobium content of from 0.63 to 1.15%.

EXAMPLE V

Samples from Heats A through J were hot rolled, cold rolled to a thickness of 0.05 inch and annealed at temperatures of from 1852° to 1870° F. The samples were subsequently tested for creep life to one percent elongation at 1600° F. under a load of 1200 pounds per square inch. The test results appear hereinbelow in Table IX.

TABLE IX

| HEAT | ANNEALING TEMPERATURE (°F.) | LIFE (hours) | EFFECTIVE NIOBIUM (wt. %) |
|---|---|---|---|
| A | 1870 | 40 | 0.74 |
| B | 1870 | 131 | 0.68 |
| C | 1866 | 33 | 0.42 |
| D | 1866 | 148 | 0.61 |
| E | 1866 | 107 | 0.38 |
| F | 1852 | 25 | 0 |
| G | 1866 | 107 | 0.80 |
| H | 1866 | 113 | 1.00 |
| I | 1866 | 51 | 1.20 |
| J | 1866 | 23 | 1.40 |

From Table IX, it is noted that none of the samples had a creep life to one percent elongation at 1600° F. under a load of 1200 pounds per square inch of 160 hours. None of the samples were processed in accordance with the subject invention, despite the fact that some of them had an effective niobium content of from 0.63 to 1.15%. Not one of them was annealed at a temperature of at least 1900° F.

EXAMPLE VI

Samples from Heats G, H and I were hot rolled, cold rolled to a thickness of 0.05 inch and annealed at temperatures of from 1852° to 2064° F. The annealed samples were studied for grain size. The results appear hereinbelow in Table X.

TABLE X

| HEAT | ANNEALING TEMPERATURE (°F.) | ASTM GRAIN SIZE NO. |
|---|---|---|
| G | 1866 | 7–8 |
| G | 1913 | 7–8 |
| G | 1950 | 5–7 |
| G | 2064 | 2–4 |
| H | 1866 | 7–8 |
| H | 1913 | 7–8 |
| H | 1950 | 7–8 |
| H | 2064 | 4–8 |
| I | 1852 | 7–8 |
| I | 1876 | 7–8 |
| I | 1940 | 7–8 |
| I | 1993 | 4–6 |

From Table X, it is noted that samples annealed at a temperature in excess of 1990° F. do not have a structure wherein substantially all of the grains are about ASTM No. 5 or finer, and that samples annealed at temperatures below 1990° F. are so characterized. As discussed hereinabove, steel which is to be cold formed after annealing should not be annealed at a temperature above 1990° F. Excessive grain growth, which is detrimental to cold formalibility, occurs at higher temperatures.

EXAMPLE VII

Samples from five heats (Heats A and K through N) were hot rolled, cold rolled to a thickness of 0.05 inch and annealed at temperatures of 1950° or 1997° F. The chemistry of the heats appears hereinbelow in Table XI.

TABLE XI

| | Composition (wt. %) | | | | | | | | | | |
|---|---|---|---|---|---|---|---|---|---|---|---|
| Heat | C | N | Cr | Al | Mo | Mn | Si | Ni | Ti | Nb | Fe |
| A | 0.017 | 0.009 | 11.50 | 0.021 | 0.01 | 0.39 | 0.43 | 0.23 | 0.14 | 0.74 | Bal. |
| K | 0.020 | 0.015 | 12.03 | 1.36 | 0.035 | 0.30 | 0.40 | 0.20 | 0.37 | 0.73 | Bal. |
| L | 0.019 | 0.011 | 12.25 | 1.93 | 0.044 | 0.36 | 0.36 | 0.26 | 0.43 | 0.80 | Bal. |
| M | 0.023 | 0.011 | 12.12 | 2.88 | 0.045 | 0.36 | 0.36 | 0.26 | 0.42 | 0.80 | Bal. |
| N | 0.021 | 0.011 | 12.02 | 3.93 | 0.045 | 0.36 | 0.36 | 0.26 | 0.43 | 0.80 | Bal. |

The samples were tested for creep life to one percent elongation at 1600° F. under a load of 1200 pounds per square inch. The test results appear hereinbelow in Table XII.

TABLE XII

| HEAT | ANNEALING TEMPERATURE (°F.) | LIFE (hours) | EFFECTIVE NIOBIUM (wt. %) |
|---|---|---|---|
| A | 1997 | 165 | 0.74 |
| K | 1997 | 208 | 0.73 |
| L | 1950 | 170 | 0.80 |
| M | 1950 | 212 | 0.80 |
| N | 1950 | 197 | 0.80 |

From Table XII, it is noted that all of the samples had a creep life to one percent elongation at 1600° F. under a load of 1200 pounds per square inch in excess of 160 hours. Significantly, each was processed within the limits of the subject invention. All had an effective niobium content within the 0.63 to 1.15% range discussed hereinabove, and all were annealed at a temperature in excess of 1900° F. Heats K through N differ from Heat A in that they have varying amounts of aluminum. As discussed hereinabove, up to 5% aluminum may be added to the alloy of the subject invention, to improve its oxidation resistance.

It will be apparent to those skilled in the art that the novel principles of the invention disclosed herein in connection with specific examples thereof will support various other modifications and applications of the same. It is accordingly desired that in construing the breadth of the appended claims they shall not be limited to the specific examples of the invention described herein.

I claim:

1. A process for producing a creep resistant ferritic stainless steel, which comprises the steps of: preparing a steel melt containing, by weight, up to 0.1% carbon, up to 0.05% nitrogen, from 11 to 20% chromium, up to 5% aluminum, up to 5% molybdenum, up to 1.5% manganese, up to 1.5% silicon, up to 0.5% nickel, up to 0.5% copper, up to 0.6% titanium, and niobium and tantalum in accordance with the following:

(a) 0.63 to 1.15% effective niobium, in the absence of tantalum (b) effective niobium and tantalum in accordance with the equation $$\frac{\text{Effective Nb}}{0.9291} + \frac{\text{Effective Ta}}{1.8095} = 0.68 \text{ to } 1.24\%.$$

when both niobium and tantalum are present; casting said steel; working said steel; and annealing said steel at a temperature of at least 1900° F. to provide said steel with a creep life to one percent elongation at 1600° F. under a load of 1200 pounds per square inch, of at least 160 hours; said effective niobium and tantalum being computed in accordance with the following:

$$\frac{\text{weight \% Ti}}{47.90} - \frac{\text{weight \% N}}{14.01} - \frac{\text{weight \% C}}{12.01} = A$$

If A is positive or zero:

Then Effective Nb content = weight % Nb

Effective Ta content = weight % Ta

If A is negative:

Then When Ta is absent

Effective Nb content =

$$92.91\left(\frac{\text{weight \% Nb}}{92.91} + A\right)$$

When Nb and Ta are present together $$92.91\left(\frac{\text{weight \% Nb}}{92.91} + A\right) = B$$

Then if B is positive or zero:

Effective Nb content = B

Effective Ta content = weight % Ta

If B is negative:

Effective Nb content = 0

Effective Ta content =

$$180.95\left(\frac{\text{weight \% Ta}}{180.95} + \frac{\text{weight \% Nb}}{92.91} + A\right).$$

2. A process according to claim 1, where the melt has up to 0.03% carbon.

3. A process according to claim 1, wherein the melt has up to 0.03% nitrogen.

4. A process according to claim 1, wherein the melt has from 0.5 to 4.5% aluminum.

5. A process according to claim 1, wherein the melt has up to 2.5% molybdenum.

6. A process according to claim 1, wherein the steel is annealed at a temperature of at least 1900° F. for a period of from 10 seconds to 10 minutes.

7. A process according to claim 1, wherein the steel is annealed at a temperature of from 1900° to 1990° F.

8. A ferritic stainless steel consisting essentially of, by weight, up to 0.1% carbon, up to 0.05% nitrogen, from 11 to 20% chromium, up to 5% aluminum, up to 5% molybdenum, up to 1.5% manganese, up to 1.5% silicon, up to 0.5% nickel, up to 0.5% copper, up to 0.6% titanium, and niobium and tantalum in accordance with the following:

(a) 0.63 to 1.15% effective niobium, in the absence of tantalum (b) effective niobium and tantalum in accordance with the equation $$\frac{\text{Effective Nb}}{0.9291} + \frac{\text{Effective Ta}}{1.8095} = 0.68 \text{ to } 1.24\%,$$

when both niobium and tantalum are present, balance essentially iron; said effective niobium and tantalum being computed in accordance with the following:

$$\frac{\text{weight \% Ti}}{47.90} - \frac{\text{weight \% N}}{14.01} - \frac{\text{weight \% C}}{12.01} = A$$

If A is positive or zero:

Then Effective Nb content = weight % Nb

Effective Ta content = weight % Ta

If A is negative:

Then When Ta is absent

Effective Nb content =

$$92.91\left(\frac{\text{weight \% Nb}}{92.91} + A\right)$$

When Nb and Ta are present together $$92.91\left(\frac{\text{weight \% Nb}}{92.91} + A\right) = B$$

Then if B is positive:

Effective Nb content = B

Effective Ta content = weight % Ta

If B is negative:

Effective Nb content = 0

Effective Ta content =

$$180.95\left(\frac{\text{weight \% Ta}}{180.95} + \frac{\text{weight \% Nb}}{92.91} + A\right)$$

said steel having a creep life to one percent elongation at 1600° F. under a load of 1200 pounds per square inch, of at least 160 hours.

9. A ferritic stainless steel according to claim 8, having up to 0.03% carbon.

10. A ferritic stainless steel according to claim 8, having up to 0.03% nitrogen.

11. A ferritic stainless steel according to claim 8, having from 0.5 to 4.5% aluminum.

12. A ferritic stainless steel according to claim 8, having up to 2.5% molybdenum.

13. A ferritic stainless steel according to claim 8, having a creep life to one percent elongation at 1600° F. under a load of 1200 pounds per square inch, of at least 250 hours.

14. A ferritic stainless steel according to claim 8, wherein the effective tantalum content is less than four times the effective niobium content.

15. A ferritic stainless steel according to claim 8, wherein said steel is characterized by a structure wherein substantially all of the grains are about ASTM No. 5 or finer.

* * * * *